US008935983B2

(12) United States Patent
Kumar et al.

(10) Patent No.: US 8,935,983 B2
(45) **Date of Patent: *Jan. 20, 2015**

(54) LOCOMOTIVE TRUCK AND METHOD FOR DISTRIBUTING WEIGHT ASYMMETRICALLY TO AXLES OF THE TRUCK

(75) Inventors: Ajith Kuttanair Kumar, Erie, PA (US); Bret Dwayne Worden, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/615,833

(22) Filed: Sep. 14, 2012

(65) Prior Publication Data

US 2013/0000507 A1 Jan. 3, 2013

Related U.S. Application Data

(63) Continuation of application No. 12/712,469, filed on Feb. 25, 2010, which is a continuation-in-part of application No. 11/833,819, filed on Aug. 3, 2007, now abandoned.

(51) Int. Cl.
*B61C 15/04* (2006.01)
*B61F 3/04* (2006.01)
*B61F 5/36* (2006.01)

(52) U.S. Cl.
CPC . *B61C 15/04* (2013.01); *B61F 3/04* (2013.01); *B61F 5/36* (2013.01)
USPC ..... 105/75; 105/194

(58) Field of Classification Search
USPC ..... 105/34.1, 34.2, 75, 82, 194, 209
See application file for complete search history.

(56) References Cited

U.S. PATENT DOCUMENTS 3,908,559 A * 9/1975 Fromm ..... 105/453
6,267,062 B1 * 7/2001 Hamilton, Jr. ..... 105/26.05
6,267,067 B1 * 7/2001 Mayerle et al. ..... 111/170

FOREIGN PATENT DOCUMENTS

DE 1035681 * 8/1958
GB 1116012 * 6/1968

* cited by examiner

*Primary Examiner* — Zachary Kuhfuss
(74) *Attorney, Agent, or Firm* — GE Global Patent Operation; John A. Kramer

(57) ABSTRACT

A locomotive (or other rail vehicle) truck and method for distributing weight asymmetrically to axles of the truck includes a first axle of a truck uncoupled from a traction system of the locomotive and a first suspension assembly coupling the first axle to the truck for applying to the first axle a first portion of a locomotive weight. The truck also includes a second axle coupled to the traction system and a second suspension assembly coupling the second axle to the truck for applying a second portion of the locomotive weight to the second axle that is greater than the first portion so that weight is asymmetrically distributed to the first axle and the second axle so as to transmit a corresponding incremental amount of tractive effort for a given amount of a driving torque applied to the second axle via the traction system of the locomotive. The axle weight distribution involves relatively slight weight distribution compared to the nominal weights normally carried by the axles.

7 Claims, 3 Drawing Sheets

LOCOMOTIVE TRUCK AND METHOD FOR DISTRIBUTING WEIGHT ASYMMETRICALLY TO AXLES OF THE TRUCK

CROSS-REFERENCE TO RELATED APPLICATIONS

This application is a continuation of U.S. patent application Ser. No. 12/712,469, filed on 25 Feb. 2010, which is a continuation-in-part application of U.S. patent application Ser. No. 11/833,819, which was filed on 3 Aug. 2007 now abandoned. The entire disclosures of both of U.S. patent application Ser. Nos. 12/712,469 and 11/833,819, are incorporated by reference.

FIELD

The subject matter herein relates to locomotives, and, more particularly, to a locomotive truck for distributing weight asymmetrically to the axles of the truck.

BACKGROUND

A diesel-electric locomotive typically includes a diesel internal combustion engine coupled to drive a rotor of at least one traction alternator to produce alternating current (AC) electrical power. The traction alternator may be electrically coupled to power one or more electric traction motors mechanically coupled to apply torque to one or more axles of the locomotive. The traction motors may include AC motors operable with AC power, or direct current motors operable with direct current (DC) power For DC motor operation, a rectifier may be provided to convert the AC power produced by the traction alternator to DC power for powering the DC motors.

AC-motor-equipped locomotives typically exhibit better performance and have higher reliability and lower maintenance than DC motor equipped locomotives. In addition, more responsive individual motor control may be provided in AC-motor-equipped locomotives, for example, via use of inverter-based motor control. However, DC-motor-equipped locomotives are relatively less expensive than comparable AC-motor-equipped locomotives. Thus, for certain hauling applications, such as when hauling relatively light freight and/or relatively short trains, it may be more cost efficient to use a DC-motor-equipped locomotive instead of an AC-motor-equipped locomotive.

For relatively heavy hauling applications, diesel-electric locomotives are typically configured to have two trucks including three powered axles per truck. Each axle of the truck is typically coupled, via a gear set, to a respective motor mounted in the truck near the axle. Each axle is mounted to the truck via a suspension assembly that typically includes one or more springs for transferring a respective portion of a locomotive weight (including a locomotive body weight and a locomotive truck weight) to the axle while allowing some degree of movement of the axle relative to the truck.

A locomotive body weight ($W_{loco}$) is typically configured to be about equally distributed between the two trucks. The locomotive weight is usually further configured to be symmetrically distributed among the axles of the trucks. In an example, where $W_{loco}$=420,000 pounds, the locomotive truck arrangement is typically configured to equally distribute the weight to the six axles of the locomotive, so that each axle supports a force of $W_{loco}/6$ pounds per axle, (e.g., 70,000 pounds per axle).

Locomotives are typically manufactured to distribute weight symmetrically to the trucks and then to the axles of the trucks so that relatively equal portions of the weight of the locomotive are distributed to the axles. Typically, the weight of the locomotive and the power rating of the locomotive determine a tractive effort capability rating of the locomotive that may he expressed as weight times a tractive effort rating. Accordingly, the weight applied to each of the axles times the tractive effort that can be applied to the axle determines a power capability of the corresponding axle. Consequently, the heavier a locomotive, the more tractive effort that it can generate at a certain speed. Additional weight, or ballast, may be added to a locomotive to bring it up to a desired overall weight for achieving a desired tractive effort capability rating. For example, due to manufacturing tolerances that may result in varying overall weights among locomotives built to a same specification, locomotives are commonly configured to be slightly lighter than required to meet a desired tractive effort rating, and then ballast is added to reach a desired overall weight capable of meeting the desired tractive effort rating.

Diesel engine powered locomotives represent a major capital expenditure for railroads, including both the initial purchase of a locomotive, but also the ongoing expense of maintaining and repairing the locomotive. In addition, hauling requirements may change over time for the railroad, so that a locomotive having a certain operating capability at a time of purchase may not meet the hauling needs of the railroad in the future. For example, a railroad looking to purchase a locomotive may only have minimal hauling needs that may be met by a relatively inexpensive low tractive effort capability locomotive, such as a DC powered locomotive having less hauling capability compared to a more expensive relatively high tractive effort locomotive, such as an AC powered locomotive. However, at some point in the useful life of the low tractive effort capability locomotive, hauling needs of the railroad may change, such that the low tractive effort capability locomotive may not he able to provide sufficient hauling capability. As a result, the railroad may need to purchase a more capable high tractive effort capability locomotive, thereby sacrificing a remaining useful life of the low tractive effort capability locomotive.

The inventors have recognized that by manufacturing one type of an item, instead of various different types of the item, a manufacturer may be able to reduce manufacturing costs by streamlining production lines. For example, a locomotive manufacturer may be able to reduce manufacturing costs by producing a single type of locomotive, such as a high tractive effort capability AC powered locomotive, instead of producing two types of locomotives, such as a high tractive effort capability AC powered locomotive and a low tractive effort capability DC powered locomotive.

What is needed is a locomotive that, for example, may be easily reconfigured as operating requirements for the locomotive change over its life. There is also a continuing need to reduce manufacturing costs. What is also needed is a locomotive truck that allocates weight differently to un-powered and powered axles, for example, of such a locomotive. Accordingly, the inventors have innovatively developed a reconfigurable locomotive that includes trucks that innovatively shift weight from an un-powered axle to a powered axle to achieve a desired tractive effort rating and/or an adhesion rating not achievable with symmetrically weighted axles.

BRIEF DESCRIPTION

An example embodiment of the inventive subject matter includes a locomotive or other rail vehicle) truck for distributing weight asymmetrically to axles of the truck. The truck includes a first axle uncoupled from a traction system of the locomotive and a first suspension assembly coupling the first axle to the truck for applying to the first axle a first portion of a locomotive weight. The truck also includes a second axle coupled to the traction system of the locomotive and a second suspension assembly. The second suspension assembly couples the second axle to the truck for applying a second portion of the locomotive weight to the second axle. The second portion of the locomotive weight is greater than the first portion of the locomotive weight so that weight is asymmetrically distributed to the first axle and the second axle, and so as to transmit a corresponding incremental amount of tractive effort for a given amount of a driving torque applied to the second axle via the traction system of the locomotive.

In another example embodiment, the inventive subject matter includes a locomotive (or other rail vehicle) truck for distributing weight asymmetrically to axles of the truck. The truck includes a first axle uncoupled from a traction system of the locomotive and a first suspension assembly coupling the first axle to the truck for applying a first portion of a locomotive weight to the first axle. The truck also includes a second axle coupled to the traction system of the locomotive and a second suspension assembly coupling the second axle to the truck for applying a second portion of the locomotive weight to the second axle. The truck also includes a third axle coupled to the traction system of the locomotive and a third suspension assembly coupling the third axle to the truck for applying a third portion of the locomotive weight to the third axle. The second and third portions of the locomotive weight are applied to the respective second axle and third axle and are greater than the first portion of the locomotive weight being applied to the first axle so that weight is asymmetrically distributed to the first axle, the second axle, and the third axle, and so as to transmit a corresponding incremental amount of tractive effort for a given amount of a driving torque applied to the second axle and third axle via the traction system of the locomotive. The axle weight distribution comprises a relatively slight weight distribution compared to a nominal weight normally carried by the axles.

In another example embodiment, the inventive subject matter includes a method for distributing weight asymmetrically to axles of a locomotive (or other rail vehicle) truck. The method includes uncoupling a first axle of the locomotive truck from a traction system of the locomotive and coupling the first axle to the truck with a first suspension assembly for applying a first portion of a locomotive weight to the first axle. The method also includes coupling a second axle of a locomotive truck to the traction system of the locomotive and coupling the second axle to the truck with a second suspension assembly for applying a second portion of the locomotive weight to the second axle. The second portion of the locomotive weight is greater than the first portion of the locomotive weight that is applied to the first axle so that weight is asymmetrically distributed to the first axle and the second axle, and so as to transmit a corresponding incremental amount of tractive effort for a given amount of a driving torque applied to the second axle via the traction system of the locomotive.

BRIEF DESCRIPTION OF THE DRAWINGS

A more particular description of the inventive subject matter briefly described above will be rendered by reference to specific embodiments thereof that are illustrated in the appended drawings. These drawings depict only typical embodiments of the inventive subject matter and are not therefore to be considered to be limiting of its scope.

DETAILED DESCRIPTION

Figure 1A:
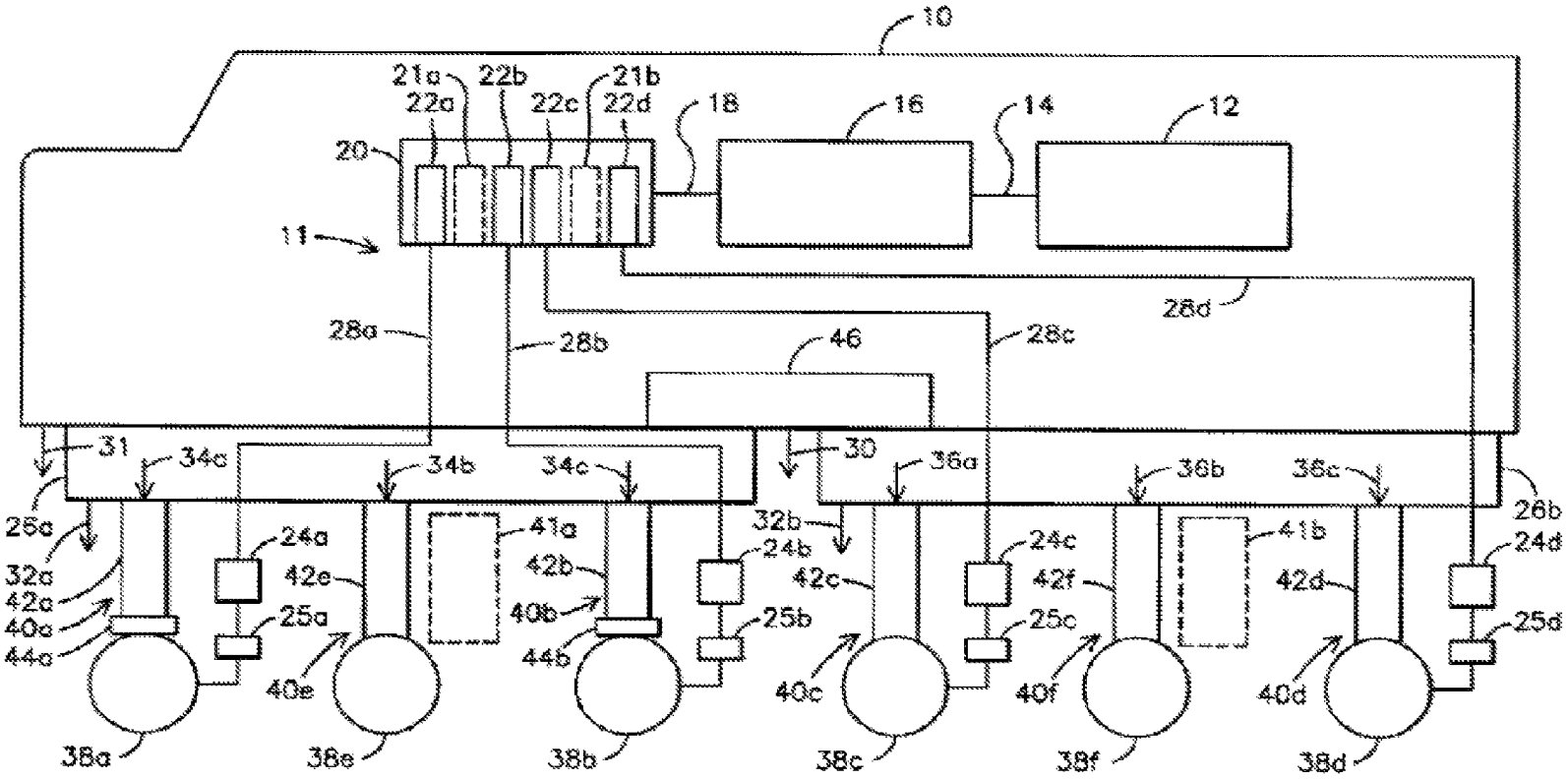
FIG. 1A is a schematic block diagram of an example embodiment of a reconfigurable locomotive having a truck for distributing a locomotive truck weight asymmetrically to axles of the locomotive.

Reference will now be made in detail to the embodiments consistent with the inventive subject matter, examples of which are illustrated in the accompanying drawings. Wherever possible, the same reference numerals are used throughout the drawings and refer to the same or like parts.

FIG. 1A is a schematic block diagram of an example embodiment of a reconfigurable locomotive 10. The locomotive 10 may include a traction system 11 having a diesel internal combustion engine 12 coupled via shaft 14 to drive a traction alternator 16 for producing AC electrical power 18. The AC electrical power 18 may be provided to a motor controller 20 that may include one or more inverters 22*a*-22*d*. Inverters 22*a*-22*d* may be configured for providing electrical power to, and for controlling respective traction motors 24*a*-24*d* located in trucks 26*a*-26*b*. The inverters 22*a*-22*d* may be electrically coupled to the respective traction motors 24*a*-24*d* with wiring harnesses 28*a*-28*d*. In an aspect of the inventive subject matter, the traction motors 24*a*-24*d* may include AC powered traction motors for converting AC electrical power into a mechanical power. The traction motors 24*a*-24*d* may be mechanically coupled to respective gear sets 25*a*-25*d* for applying power in the form of driving torque to a corresponding powered axle 38*a*-38*d*. it should be understood that although an AC type locomotive system is described above, aspects of the inventive subject matter may also be used with DC locomotives and other locomotive power configurations as well.

A static weight 30 of the locomotive 10, for example, including a locomotive body weight 31 and truck weights 32*a*, 32*b*, is supported by the axles 38*a*-38*f* of the trucks 26*a*-26*b*. Accordingly, the static weight 30 supported by any one axle may include a portion of the locomotive body weight 31 of the locomotive 10 supported by the truck to which the axle is coupled and the truck weight, e.g., truck weight 32*a*, 32*b*. The axles 38*a*-38*f* may be coupled to the trucks 26*a*, 26*b* by one or more suspension assemblies 40*a*-40*f* that may include one or more springs 42*a*-42*f* and/or shims 44*a*, 44*b*.

In an embodiment, each of the axles of the trucks has substantially the same weight/normal force capability. This means that all the axles have substantially equal weight-carrying capability, meaning equal but for standard manufacturing tolerances or nominal deviations, as will be readily understood by one skilled in the art. It will be appreciated that the total axle weight has both static and dynamic components, which in one example embodiment may combine to yield values on the order of approximately 120% of a nominal static weight. It will be appreciated that the magnitude of the static weight distribution achieved in accordance with aspects of the inventive subject matter will not require any structural modifications for the axles of the truck to accommodate the magnitude of the static weight distribution. This means that the axles are structurally the same, subject to standard manufacturing tolerances or nominal deviations, as will be readily understood by one skilled in the art.

In an aspect of the inventive subject matter, one or more axles of trucks 26*a*, 26*b*, such as axles 38*e*, 38*f*, may be left un-powered in a baseline configuration. Consequently, the associated assemblies normally deployed with the un-powered axles, such as inverters, traction motors, and/or gear sets, may be absent in a baseline configuration. By reducing a number of traction components, users requiring a less tractive effort capable and/or less powerful locomotive may be able to save on the cost of purchasing such a locomotive compared to a locomotive having a full complement of traction components. Furthermore, manufacturers of such locomotives may save on production costs because they only need to produce one baseline locomotive design and simply add traction components and/or refrain for installing traction components to achieve a desired capability of a locomotive, instead of having to produce entirely different models having different capabilities. Spaces in the locomotive 10 normally occupied by components of the traction system 11, such as a space 41*a* in the truck 26*a* normally reserved for housing a traction assembly, and/or a space 21 (e.g., space 21*a* or another space 21*b*) in the motor controller 20, normally reserved for an inverter, may be left vacant in a baseline locomotive design.

Figure 1B:
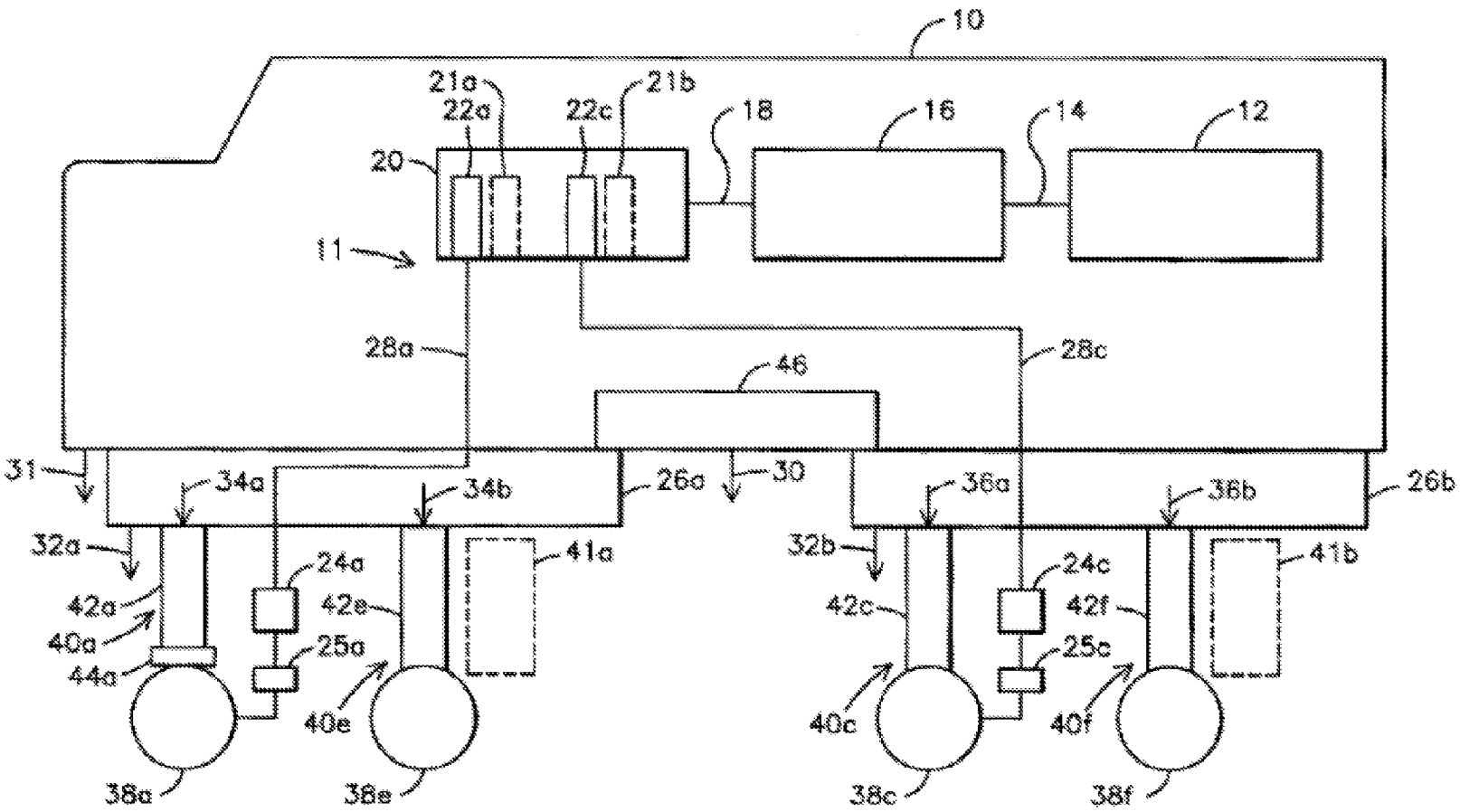
FIG. 1B is a schematic block diagram of an example embodiment of a reconfigurable locomotive having a truck for distributing a locomotive truck weight asymmetrically to axles of the locomotive.

An example embodiment of the inventive subject matter, shown in FIG. 1B, relates to a locomotive truck, e truck 26*a*, for distributing a locomotive truck weight asymmetrically to axles, e.g., a first axle 38*a* and a second axle 38*e*, of the truck 26*a*. Axle 38*e* of a locomotive truck 26*a* may be uncoupled from the traction system 11 of the locomotive 10 and a suspension assembly 40*e* may couple axle 38*e* to the truck 26*a* for applying a first portion 34*b* of the weight 30 of the locomotive 10 to axle 38*e*. For example, truck 26*a* may be configured without a motor or gear set normally used for powering axle 38*e*. Accordingly, axle 38*e* may be configured to act as an un-powered, idler axle that functions to support portion 34*b* of the locomotive weight 30 in the absence of the traction system components normally needed to drive the axle 38*e* (and, with respect to the truck 26*b*, axle 38*f* may be configured to act as an un-powered, idler axle that functions to support portion 36*b* of the locomotive weight 30 in the absence of the traction system components normally needed to drive the axle 38*f*). Axle 38*a* of the locomotive truck 26*a* may be coupled to the traction system 11, and a suspension assembly 40*a* may couple the axle 38*a* to the truck 26*a* for applying a second portion 34*a* of the weight 30 being applied by the locomotive 10 to the axle 38*a* (and, with respect to the truck 26*b*, applying a second portion 36*a* of the weight 30 being applied by the locomotive 10). The portion 34*b* of the weight 30 may be different from the portion 34*a* of the weight 30 being applied to the axle 38*a* so that the locomotive weight 30 is asymmetrically distributed to axle 38*e* and axle 38*a*. This asymmetrical distribution of the weight 30 may be configured to allocate more weight to axle 38*a* so as to transmit a corresponding incremental amount of tractive effort for a given amount of a driving torque applied to the axle 38*a* via the traction system 11 of the locomotive 10. The first axle comprises an axle similar in capacity to the second axle. For example, in the event the locomotive were to be reconfigured so that the first axle is coupled to the traction system of the locomotive, the first axle can accept and withstand tractive effort from the traction system of the locomotive.

In an embodiment, the portion 34*a* of the weight 30 applied to axle 38*a* coupled to the traction system 11 may be greater than portion 34*b* of the weight 30 applied to the axle 38*e* uncoupled from the traction system so that more weight is allocated to axle 38*a*. Accordingly, weight may be transferred from an un-powered axle 38*e* that does not provide tractive effort, to a powered axle 38*a* so that more tractive effort may be generated by axle 38*a* compared to a conventional configuration wherein the weight 30 is symmetrically distributed to the axles 38*a*, 38*b*. For example, if 5000 pounds of weight normally applied to axle 38*e* is relieved from bearing on axle 38*e* and allocated to axle 38*a*, an additional tractive effort proportional to the additional 5000 pounds allocated to axle 38*a* may be transmitted by axle 38*a*. Advantageously, by allocating more weight to the powered axle 38*a*, adhesion control may be improved compared to an arrangement wherein weight is symmetrically allocated to the axles 38*a* and 38*e*.

In an example embodiment for distributing weight asymmetrically, suspension assembly 40*a* and suspension assembly 40*e* may comprise respective springs 42*a*, 42*e* having different characteristics that provide different weight loading responses. For example, the different characteristics may comprise different spring constants and/or different spring geometries. For example, spring 42*a* may comprise a stiffer spring constant than a spring constant of spring 42*e*. In another embodiment, the different spring geometry may include a different spring length in a direction of spring compression. For example, a length of spring 42*a* may be longer than a length of spring 42*e*.

In another embodiment, suspension assembly 40*a* and suspension assembly 40*e* may include respective springs 42*a*, 42*e* having equivalent characteristics, wherein at least one of the suspension assembly 40*a* and suspension assembly 40*e* include a shim, e.g. shim 44*a*, for configuring the corresponding suspension assembly, e.g., suspension assembly 40*a*, to have a different characteristic than the other suspension assembly, e.g., suspension assembly 40*e* For example, shim 44*a* may effectively shorten, or pre-compress, spring 42*a* so that more weight is allocated to axle 38*a* compared to an un-shimmed suspension assembly 40*e* including a spring 42*e* having an equivalent characteristic as spring 42*a*. In another aspect of the inventive subject matter, a smaller wheel diameter of a less weighted axle 38*e* compared to a wheel diameter of a more weighted axle 38*a* may be initially proved due to the fact that the more weighted axle 38*a* will wear faster.

In yet another embodiment depicted in FIG. 1A, the locomotive truck may include a third axle, e.g., axle 38*b*, coupled to the traction system 11 of the locomotive to and another suspension assembly 40*b* coupling axle 38*b* to the truck 26*a* for applying a third portion 34*c* of the weight 30 to the axle 38*b*. Portion 34*c* applied to the axle 38*b* may be different from portion 34*b* applied to axle 38*e* so that the weight 30 is asymmetrically distributed to axle 38*a*, axle 38*e*, and axle 38*b*. The asymmetrical distribution may be configured to allocate more weight to axle 38*a* and axle 38*b* so as to transmit a corresponding incremental amount of tractive effort for a given amount of a driving torque applied to axle 38*a* and axle 38*b* via the traction system 11 of the locomotive 10. For example, portion 34*a* and portion 34*c* applied to the respective axle 38*a* and axle 38*b* may be greater than the portion 34*b* of the weight 30 applied to axle 38*e*, so that more weight is allocated to axle 38*a* and axle 38*b* (and, with respect to truck 26*a*, portion 36*a* and portion 36*c* applied to the respective axle 38*c* and axle 38*d* may be greater than the portion 36*b* applied to axle 38*f* so that more weight is allocated to axle 38*c* and axle 38*d*) In another aspect, the weights allocated to axle 38*a* and axle 38*b* may be symmetric with respect to each other, but different than the weight allocated to axle 38*e*.

The examples below represent asymmetrical axle weight distribution in accordance with aspects of the inventive subject matter, where the values are listed in a descending numerical order regarding the magnitude of asymmetrical axle weight distribution. In a first example, the asymmetrical axle weight distribution may be represented by the following weight axle ratios, 74/60/74. It is believed that the ratios of the first example may approximate an upper bound that takes into account various considerations regarding the extent to which static weight can be practically shifted to the powered axles. These considerations may include rail forces, the impact on friction braking related wheel to rail adhesion required to avoid slides, as well as truck component stress.

In a second example, the asymmetrical axle weight distribution may be represented by the following weight axle ratios, 72/64/72. In a third example, the normalized asymmetrical axle weight distribution may be represented by the following weight axle ratios 70/68/70, it is believed that the distribution values of the third example may approximate a lower bound regarding static weight shifting of practical utility. It will be appreciated that the foregoing values (upon rounding) correspond to an example range from approximately 55%/45% weight distribution to approximately 51%/49% distribution, where a second axle coupled to the traction system carries the larger percentage relative to a first axle uncoupled from the traction system. It will be appreciated that the foregoing values (upon rounding) in a three-way percentage distribution correspond to a range front approximately 33.6%, 32.7%, 33.6% to approximately 35.5%, 29.0%, 35.5%, where a second axle and a third axle coupled to the traction system carry the larger percentage values relative to a first axle uncoupled from the traction system, and where the first axle is positioned between the second and the third axles. The first axle comprises an axle similar in capacity to the second and third axles. For example, in the event the locomotive was to be reconfigured so that the first axle is coupled to the traction system of the locomotive, the first axle can accept and withstand tractive effort from the traction system of the locomotive.

In view of the foregoing considerations, it will be appreciated that the weight distribution achieved in accordance with aspects of the inventive subject matter represents a relatively slight weight distribution compared to a nominal weight normally carried by the axles, and as noted above, this means that all the axles have the same weight-carrying capability, subject to manufacturing tolerances or nominal deviations, as will be understood by one skilled in the art.

In another embodiment, suspension assemblies 40*a*, 40*e* and 40*b*, include respective springs 42*a*, 42*e* and 42*b* having different characteristics. The different characteristics may include different spring constants and/or different characteristics comprise different spring geometries. For example, spring 42*a* may comprise a stiffer spring constant than a spring constant of spring 42*e*. In another embodiment, the different spring geometry may include a different spring length in a direction of spring compression. For example, a length of spring 42*a* may be longer than a length of spring 42*e* In another example embodiment, springs 42*a*, 42*e* and 42*b* may include equivalent characteristics, wherein at least one of the first suspension assemblies 40*a*, 40*e* and 40*b* include a shim, such as shims 44*a*, 44*b* for configuring the corresponding suspension assembly e.g., suspension assembly 40*a*, 40*b* to have different characteristics than the other suspension assembly, e.g., suspension assembly 40*e*. For example, shim 44*a* may effectively shorten, or pre-compress, spring 42*a* so that more weight is allocated to axle 38*a* compared to an un-shimmed suspension assembly 40*e* including a spring 42*e* having an equivalent characteristic as spring 42*a*.

In another example embodiment, an amount and/or position of a ballast 46 on the locomotive 10 relative to the trucks 26*a*, 26*b* may be configured responsive to a number of axles coupled to the traction system 11 in the trucks 26*a*, 26*b*. For example, referring to FIG. 1B, if truck 26*a* has its two axles 38*a*, 38*e* coupled to the traction system 11, and truck 26*b* has axle 38*c* coupled to the traction system 11 and axle 38*f* uncoupled from the traction system 11, then the ballast 46 may be positioned on the locomotive 10 so that it is closer to truck 26*a* than 26*b*. Accordingly, the position of the ballast 46 may be configured to asymmetrically apply more of the weight to truck 26*a* to allow transmitting a corresponding incremental amount of tractive effort for a given amount of a driving torque applied to the coupled axles of truck 26*a* via the traction system 11 of the locomotive 10.

Figure 2:
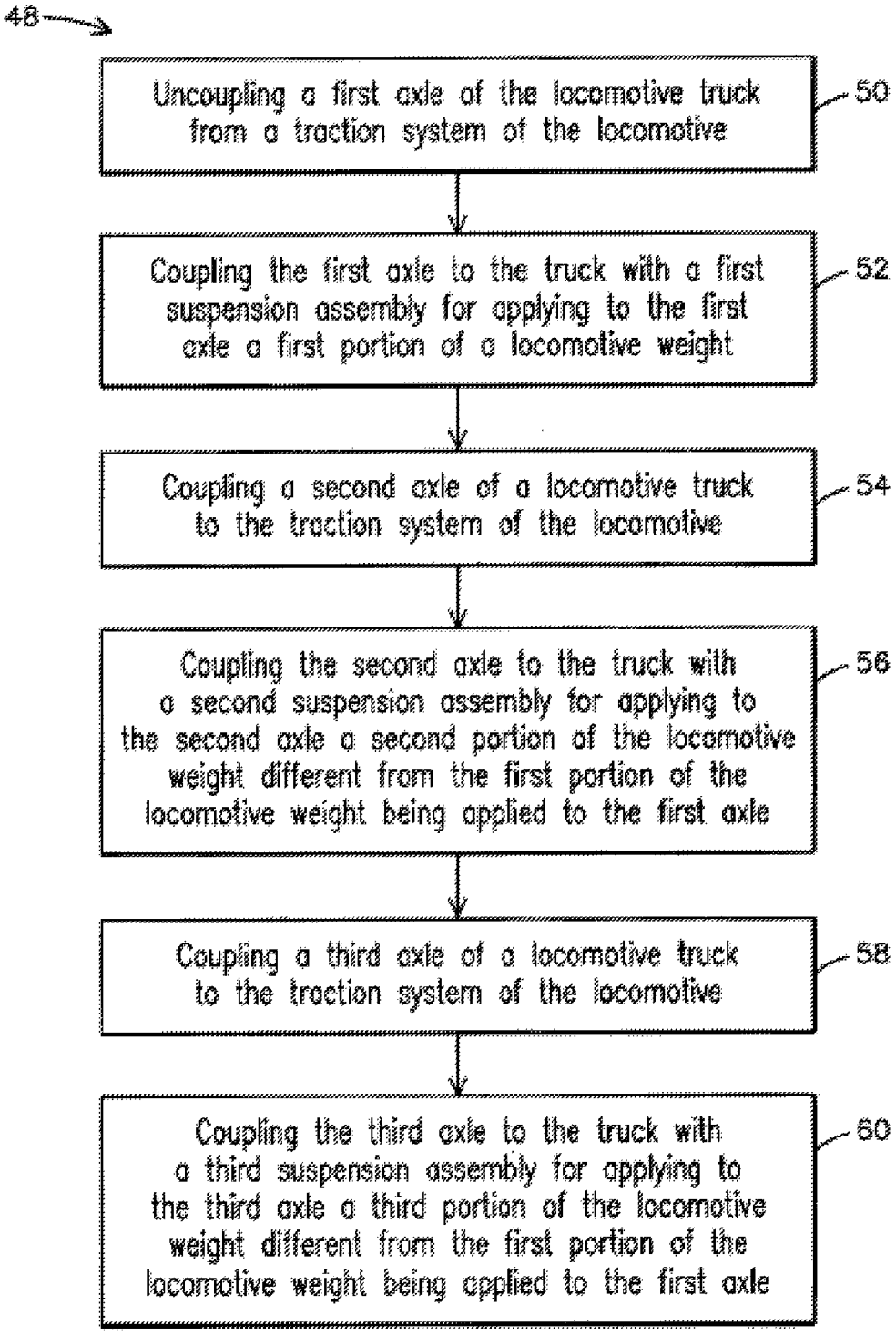
FIG. 2 is a flow diagram of an example embodiment of a method for distributing weight asymmetrically to axles of locomotive.

In another example embodiment depicted in the flow diagram 48 of FIG. 2, and with reference to FIG. 1A and FIG. 1B, a method for distributing a locomotive weight 30 asymmetrically to axles thereof may include uncoupling 50 axle 38*e* of the locomotive truck 26*a* from the traction system 11 of the locomotive 10. The method may also include coupling 52 axle 38*e* to the truck 26*a* with a first suspension assembly 40*e* for applying a first portion 34*b* of a locomotive weight 30 to the axle 38*e* The method may also include coupling 54 axle 38*a* to the traction system 11, and then coupling 56 axle 38*a* to the truck 26*a* with a second suspension assembly 40*a* for applying a second portion 34*a* of the locomotive weight 30 to axle 38*a* that is different from, such as greater than, portion 34*b* of the locomotive weight 30 being applied to axle 38*e* so that weight is asymmetrically distributed to axle 38*a* and axle 38*e*. In an aspect of the inventive subject matter, the asymmetrical distribution is configured to allocate more of the weight 30 to axle 36*a* so as to transmit a corresponding incremental amount of tractive effort for a given amount of a driving torque applied to axle 38*a* via the traction system 11 of the locomotive 10.

The method may further include coupling 56 a third axle, e.g. axle 38*b* of the locomotive truck 26*a* to the traction system 11 of the locomotive 10 and coupling 60 axle 38*b* to the truck 26*a* with a third suspension assembly for applying a third portion 34*c* of the weight 30 to axle 38*b* that is different from, such as greater than, the first portion 34*h* of the weight 30 being applied to axle 38*e*.

In an embodiment of a rail vehicle truck, each of two or more axles in a truck (e.g., the truck may have two or three axles) includes at least one traction wheel that contacts the rail(s) or other guideway over which the rail vehicle travels, wherein: (i) each such traction wheel is driven through rotation of the axle to which it is attached for moving the rail vehicle along the rail(s) or other guideway, e.g., the axle may be rotated by a traction motor that drives a gear system attached to the axle; and (ii) each such traction wheel has substantially the same outer diameter, meaning the same but for manufacturing variances and operational wear. In another embodiment, all the support wheels of a rail vehicle (meaning all wheels which support rail vehicle weight and contact an underlying rail(s) or other guideway over which the rail vehicle travels) have substantially the same outer diameter.

Although embodiments of the inventive subject matter have been described herein with reference to locomotives, all the embodiments and teachings set forth herein are applicable to rail vehicles more generally ("rail vehicle" referring to a vehicle that travels along a rail or set or rails or other guideway).

While embodiments of the inventive subject matter have been described with reference to an exemplary embodiment, it will be understood by those of ordinary skill in the art that various changes, omissions and/or additions may be made and equivalents may be substituted for elements thereof without departing from the spirit and scope of the inventive subject matter. In addition, many modifications may be made to adapt a particular situation or material to the teachings of the inventive subject matter without departing from the scope thereof. Therefore, it is intended that the inventive subject matter not be limited to the particular embodiment disclosed as the best mode contemplated for carrying out this inventive subject matter, but that the inventive subject matter will include all embodiments falling within the scope of the appended claims.

What is claimed is:

1. A method comprising:

coupling a powered first axle of a first rail vehicle truck with a traction system of a rail vehicle so that the powered first axle can receive tractive effort from the traction system to propel the rail vehicle;

coupling the powered first axle to the first rail vehicle truck with a first suspension assembly that applies a first portion of a rail vehicle weight to the powered first axle;

coupling a powered second axle of the first rail vehicle truck with the traction system of the rail vehicle so that the powered second axle can receive tractive effort from the traction system to propel the rail vehicle;

coupling the powered second axle to the first rail vehicle truck with a second suspension assembly that applies a second portion of the rail vehicle weight to the powered second axle, wherein the first portion of the rail vehicle weight that is applied to the powered first axle differs from the second portion of the rail vehicle weight that is applied to the powered second axle;

coupling an unpowered third axle to a third suspension assembly of the first rail vehicle truck, the unpowered third axle decoupled from the traction system of the rail vehicle such that the unpowered third axle does not receive tractive effort from the traction system to propel the rail vehicle;

wherein the third suspension assembly applies a third portion of the rail vehicle weight to the unpowered third axle that differs from the first portion of the rail vehicle weight that is applied to the powered first axle and the second portion of the rail vehicle weight that is applied to the powered second axle, the first and second portions of the rail vehicle weight being greater than the third portion of the rail vehicle weight; and coupling one or more additional axles to a second rail vehicle truck of the rail vehicle via one or more additional suspension assemblies so that the one or more additional axles receive one or more additional portions of the rail vehicle weight; and providing a moveable ballast on the rail vehicle that is configured to be moved closer to the first rail vehicle truck than the second rail vehicle truck to increase at least one of the first portion or the second portion of the rail vehicle weight applied to at least one of the powered first axle or the powered second axle, respectively, of the first rail vehicle truck and to decrease the one or more additional portions of the rail vehicle weight applied to the one or more additional axles of the second rail vehicle truck.

2. The method of claim 1, wherein providing the ballast includes providing the ballast to be configured to be moved closer to the second rail vehicle truck to increase the one or more additional portions of the rail vehicle weight that is applied to the one or more additional axles of the second rail vehicle truck and to decrease at least one of the first portion or the second portion of the rail vehicle weight that is applied to at least one of the powered first axle or the powered second axle, respectively, of the first rail vehicle truck.

3. A method comprising:

coupling a powered first axle of a first rail vehicle truck with a traction system of a rail vehicle so that the powered first axle can receive tractive effort from the traction system to propel the rail vehicle;

coupling the powered first axle to the first rail vehicle truck with a first suspension assembly that applies a first portion of a rail vehicle weight to the powered first axle;

coupling a powered second axle of the first rail vehicle truck with the traction system of the rail vehicle so that the powered second axle can receive tractive effort from the traction system to propel the rail vehicle;

coupling the powered second axle to the first rail vehicle truck with a second suspension assembly that applies a second portion of the rail vehicle weight to the powered second axle, wherein the first portion of the rail vehicle weight that is applied to the powered first axle differs from the second portion of the rail vehicle weight that is applied to the powered second axle;

coupling one or more additional axles to a second rail vehicle truck of the rail vehicle via one or more additional suspension assemblies so that the one or more additional axles receive one or more additional portions of the rail vehicle weight; and providing a moveable ballast on the rail vehicle that is configured to be moved closer to the first rail vehicle truck than the second rail vehicle truck to increase at least one of the first portion or the second portion of the rail vehicle weight applied to at least one of the powered first axle or the powered second axle, respectively, of the first rail vehicle truck and to decrease the one or more additional portions of the rail vehicle weight applied to the one or more additional axles of the second rail vehicle truck.

4. The method of claim 3, wherein providing the ballast includes providing the ballast to be configured to be moved closer to the second rail vehicle truck to increase the one or more additional portions of the rail vehicle weight that is applied to the one or more additional axles of the second rail vehicle truck and to decrease at least one of the first portion or the second portion of the rail vehicle weight that is applied to at least one of the powered first axle or the powered second axle, respectively, of the first rail vehicle truck.

5. The method of claim 3, further comprising:

coupling an unpowered third axle to a third suspension assembly of the rail vehicle truck, the unpowered third axle decoupled from the traction system of the rail vehicle such that the unpowered third axle does not receive tractive effort from the traction system to propel the rail vehicle;

wherein the third suspension assembly applies a third portion of the rail vehicle weight to the unpowered third axle that differs from the first portion of the rail vehicle weight that is applied to the powered first axle and the second portion of the rail vehicle weight that is applied to the powered second axle.

6. A system comprising:

a first rail vehicle truck of a rail vehicle, the first rail vehicle truck having a powered first axle and a powered second axle, the powered first axle and the powered second axle coupled with a traction system of the rail vehicle so that the powered first axle and the powered second axles can receive tractive effort from the traction system to propel the rail vehicle, wherein the powered first axle is couple to the first rail vehicle truck with a first suspension assembly that is configured to apply a first portion of a rail vehicle weight to the powered first axle, and wherein the powered second axle is coupled to the first rail vehicle truck with a second suspension assembly that is configured to apply a second portion of the rail vehicle weight to the powered second axle, wherein the first portion of the rail vehicle weight that is applied to the powered first axle differs from the second portion of the rail vehicle weight that is applied to the powered second axle;

one or more additional axles coupled to a second rail vehicle truck of the rail vehicle via one or more additional suspension assemblies so that the one or more additional axles receive one or more additional portions of the rail vehicle weight; and a moveable ballast on the rail vehicle that is configured to be moved closer to the first rail vehicle truck than the second rail vehicle truck to increase at least one of the first portion or the second portion of the rail vehicle weight applied to at least one of the powered first axle or the powered second axle, respectively, of the first rail vehicle truck and to decrease the one or more additional portions of the rail vehicle weight applied to the one or more additional axles of the second rail vehicle truck.

7. The system of claim 6, further comprising:

an unpowered third axle coupled to a third suspension assembly of the first rail vehicle truck, the unpowered third axle decoupled from the traction system of the rail vehicle such that the unpowered third axle does not receive tractive effort from the traction system to propel the rail vehicle, wherein the third suspension assembly is configured to apply a third portion of the rail vehicle weight to the unpowered third axle that differs from the first portion of the rail vehicle weight that is applied to the powered first axle and the second portion of the rail vehicle weight that is applied to the powered second axle, the first and second portions of the rail vehicle weight being greater than the third portion of the rail vehicle weight.

* * * * *

UNITED STATES PATENT AND TRADEMARK OFFICE

CERTIFICATE OF CORRECTION

PATENT NO. : 8,935,983 B2
APPLICATION NO. : 13/615833
DATED : January 20, 2015
INVENTOR(S) : Kumar et al.

It is certified that error appears in the above-identified patent and that said Letters Patent is hereby corrected as shown below:

In the Specification

In Column 1, Line 33, delete “power” and insert -- power. --, therefor.

In Column 2, Line 7, delete “may he” and insert -- may be --, therefor.

In Column 2, Line 37, delete “may not he” and insert -- may not be --, therefor.

In Column 2, Line 67, delete “or other” and insert -- (or other --, therefor.

In Column 5, Line 27, delete “e truck” and insert -- e.g., truck --, therefor.

In Column 6, Line 34, delete “40e” and insert -- 40e. --, therefor.

In Column 6, Line 45, delete “locomotive to” and insert -- locomotive 10 --, therefor.

In Column 6, Line 63, delete “38d)” and insert -- 38d). --, therefor.

In Column 7, Line 17, delete “70/68/70, it” and insert -- 70/68/70. It --, therefor.

In Column 7, Line 27, delete “front” and insert -- from --, therefor.

In Column 8, Line 24, delete “axle 38e” and insert -- axle 38e. --, therefor.

In Column 8, Line 33, delete “36a” and insert -- 38a --, therefor.

In Column 8, Line 37, delete “56 a” and insert -- 58 a --, therefor.

In Column 8, Line 42, delete “34h” and insert -- 34b --, therefor.

In the Claims

In Column 10, Line 67, in Claim 6, delete “couple” and insert -- coupled --, therefor.

Signed and Sealed this
Twenty-eighth Day of April, 2015

Michelle K. Lee

Michelle K. Lee
*Director of the United States Patent and Trademark Office*